US008261945B2

(12) United States Patent
Haworth

(10) Patent No.: US 8,261,945 B2
(45) Date of Patent: Sep. 11, 2012

(54) SOAP DISPENSING APPARATUS

(75) Inventor: Brian D. Haworth, Voorburg (NL)
(73) Assignee: Diversey, Inc., Sturtevant, WI (US)

( * ) Notice: Subject to any disclaimer, the term of this patent is extended or adjusted under 35 U.S.C. 154(b) by 1089 days.

(21) Appl. No.: 11/913,507
(22) PCT Filed: May 2, 2006

(86) PCT No.: PCT/US2006/016583
§ 371 (c)(1), (2), (4) Date: Jun. 16, 2008

(87) PCT Pub. No.: WO2006/119163
PCT Pub. Date: Nov. 9, 2006

(65) Prior Publication Data

US 2009/0212073 A1 Aug. 27, 2009

Related U.S. Application Data

(60) Provisional application No. 60/700,819, filed on Jul. 20, 2005.

(30) Foreign Application Priority Data

May 3, 2005 (EP) ..... 05076055

(51) Int. Cl.
*B67D 7/06* (2010.01)

(52) U.S. Cl. ..... 222/181.3; 222/105; 222/190; 222/207; 222/182; 222/321.8; 222/181.2; 222/325; 222/509; 222/183; 222/570

(58) Field of Classification Search ..... 222/180, 222/181.3, 183, 321.1, 321.7–321.9, 325, 222/372, 383.1, 570, 630–633, 182, 153.03–153.04, 222/41, 74, 509, 575, 105, 181.2, 207, 214, 222/190
See application file for complete search history.

(56) References Cited

U.S. PATENT DOCUMENTS 4,775,078 A * 10/1988 Schick et al. ..... 222/212
(Continued)

FOREIGN PATENT DOCUMENTS

DE 29601918 6/1997
(Continued)

OTHER PUBLICATIONS

The International Search Report prepared by the European Patent Office.

(Continued)

*Primary Examiner* — Kevin P Shaver
*Assistant Examiner* — Andrew P Bainbridge
(74) *Attorney, Agent, or Firm* — Gregory S. Bollis

(57) ABSTRACT

A soap dispenser has a base and a cover attached to the base by two sets of hinges. A container of soap is housed between the cover and the base and is attached to a liquid or foam dispensing pump. The pump is housed within a mounting device which surrounds the pump and has several diameters and at least one shoulder. In at least one embodiment, the mounting device has a flexible arm that biases the cover to a non-actuated position. The portion of the mounting device farthest from the pump's dispensing orifice and located closest to the soap container is flat in at least one embodiment on two opposite surfaces, which assists in orienting the pump correctly. As the portion is not circular, it must be oriented correctly. In at least one embodiment, as the cover is depressed, the pump actuates to dispense foam or soap.

34 Claims, 15 Drawing Sheets

U.S. PATENT DOCUMENTS

| | | | | |
|---|---|---|---|---|
| 5,100,030 | A * | 3/1992 | Roggenburg et al. | 222/181.2 |
| 5,207,355 | A | 5/1993 | Thomsen et al. | |
| 5,209,377 | A * | 5/1993 | Steiner et al. | 222/189.09 |
| 5,397,028 | A * | 3/1995 | Jesadanont | 222/1 |
| 5,501,372 | A * | 3/1996 | Daansen | 222/207 |
| 5,642,908 | A * | 7/1997 | Mascitelli | 285/148.19 |
| 5,649,650 | A * | 7/1997 | Klauke | 222/570 |
| 5,680,959 | A * | 10/1997 | Ettore et al. | 222/1 |
| 5,862,956 | A * | 1/1999 | Brandenburg et al. | 222/214 |
| 5,873,491 | A * | 2/1999 | Garcia et al. | 222/95 |
| 5,887,759 | A * | 3/1999 | Ayigbe | 222/192 |
| 6,053,370 | A * | 4/2000 | Ludbrook et al. | 222/207 |
| 6,607,103 | B2 * | 8/2003 | Gerenraich et al. | 222/183 |
| 6,698,623 | B2 * | 3/2004 | Petit | 222/153.12 |
| 6,729,502 | B2 * | 5/2004 | Lewis et al. | 222/181.3 |
| 6,877,642 | B1 * | 4/2005 | Maddox et al. | 222/181.3 |
| 7,048,152 | B2 * | 5/2006 | Bunoz | 222/182 |
| 2002/0005414 | A1 | 1/2002 | DeKoning et al. | |
| 2002/0195464 | A1 * | 12/2002 | Fuchs | 222/137 |
| 2004/0173635 | A1 * | 9/2004 | Bunoz | 222/183 |
| 2004/0232168 | A1 * | 11/2004 | Ciavarella et al. | 222/156 |
| 2005/0006408 | A1 * | 1/2005 | Ganzeboom | 222/190 |

FOREIGN PATENT DOCUMENTS

| | | |
|---|---|---|
| EP | 1454576 | 9/2004 |
| EP | 1719441 | 11/2006 |
| WO | 00/67628 | 11/2000 |
| WO | 2004/052162 | 6/2004 |

OTHER PUBLICATIONS

Notification of Reason for Refusal issued by the Japanese Patent Office—Date of Dispatch: May 23, 2011.

* cited by examiner

SOAP DISPENSING APPARATUS

CROSS-REFERENCE TO RELATED APPLICATIONS

This claims priority to European Patent Application Number 05076055.2 filed on May 37, 2005, and U.S. Provisional Patent Application No. 60/700,819, filed on Jul. 20, 2005, the contents of each application are hereby incorporated by reference.

BACKGROUND OF THE INVENTION

Many prior art soap dispensing apparatuses have a housing defined by a cover connected to a base. A cartridge, bag, or pouch of soap is stored within the housing such that it can be selectively dispensed. In such dispensing apparatuses, the cover may need to be detached from the base part to change the cartridge.

Furthermore, the insertion of a new cartridge can be somewhat challenging. A pump assembly may need to be connected to and properly aligned on the cartridge to place the pump nozzle in the correct position for dispensing.

SUMMARY OF THE INVENTION

The present invention is intended to provide an improved dispensing apparatus which is easy to operate and cartridges can be exchanged easily.

Some embodiments of the invention relate to an apparatus or components thereof for dispensing certain quantities of liquid or foamed soap contained in disposable or reusable containers which can be replaced when the container is empty.

Some embodiments are particularly directed toward a dispenser utilizing a container or cartridge discussed above. Generally, such dispensers have a base and cover. In order to change the cartridge, the cover on the dispenser should be released from the base plate. This operation should only be performed by certain authorized people, whereas it should be impossible or at least not easy for users of the dispensing apparatus to release the cover.

The dispenser of some embodiments utilizes the cover as an operating button for dispensing. By pushing on the cover, product will be dispensed. For replacing the cartridge of some embodiments, it must be possible to pivot the cover to a cartridge-loading position while it keeps connected to the base part. The cover can also be pivoted about a hinge point with respect to the base plate in order to dispense the product. The cover can be opened for replacing the cartridge when the hinge point between the cover and the base plate is released.

In some embodiments, the dispensing apparatus is characterized in that a second hinge point is arranged between the cover and a mounting element, which is locked in the base part. Upon unlocking the mounting element, the mounting element with cover can be moved relative to the base part for releasing the first hinge point.

In a preferred embodiment the locking of the mounting element is realized in that the mounting element comprises at least an extended portion cooperating with an opening in the base part.

In some embodiments, the base part comprises at least a retention rib cooperating with the extended portion of the mounting element for preventing the cover from separating from the base part. An unintended removal of the cover from the base part is herewith prevented.

In a preferred embodiment the first hinge point is arranged between the cover and the base part and releasable by relative movement between those two. After the mounting element is unlocked from the base part, the cover can be moved relative to the base part in a direction of releasing the first hinge point.

Additionally, cooperating blocking means between the cover and the base part for blocking relative movement between those two are preferably provided. In this embodiment, the mounting element, should be unlocked from the base part and the blocking means between the cover and the base part should be brought into their non-cooperating position in order to move the cover with respect to the base part and release the first hinge point.

In a further embodiment the dispensing apparatus also comprises resilient means for returning the cover about the first hinge point to a non-dispensing position after releasing the cover wherein the resilient means are integrally connected to the mounting element.

In a preferred embodiment the resilient means comprise at least a flexible arm of the mounting element. The mounting element can preferably be produced from plastic. Flexibility of the arm is obtained by having proper dimensions and material.

In a further preferred embodiment a first part of the second hinge point is integrally connected to the flexible arm of the mounting element and a second part of the second hinge point is connected to the cover.

In another preferred embodiment the first part comprises a pivot hole in the flexible arm and the second part comprises a pivoting pin integrally connected to the cover.

In some embodiments, the cartridge includes a container of the product and a pump connected thereto, although it is also possible to have a separate pump arranged in the dispensing apparatus which is not replaced when the cartridge is empty. There are several different types of pumps possible for use with the container of product, such as a bellows pump, a foam pump, a hose pump or a container having a flexible wall which can be depressed by some kind of pushing element.

According to one embodiment of the invention when the dispensing apparatus is suited for a cartridge with a bellows pump, an actuating element is provided which is pivotally connected to the mounting element for actuating the bellows pump. The pivoting movement of the cover with respect to the base part for dispensing product is translated into an actuation movement of the bellows pump by this actuating element.

According to another embodiment of the invention, the dispensing apparatus is suited for a cartridge with a foam pump. The pivoting movement of the cover with respect to the base part for dispensing product causes direct actuation of the foam pump.

Some embodiments of the present invention provide a new housing for connecting a foam pump to the soap container. The housing can have a generally cylindrical body with one or more alignment features for aligning the pump on a container of soap in a proper dispensing position. Furthermore, the housing can have features that allow the pump to be coupled to the pump in a faster manner.

Further aspects of the present invention, together with the organization and operation thereof, will become apparent from the following detailed description of the invention when taken in conjunction with the accompanying drawings.

DETAILED DESCRIPTION

Figure 1:
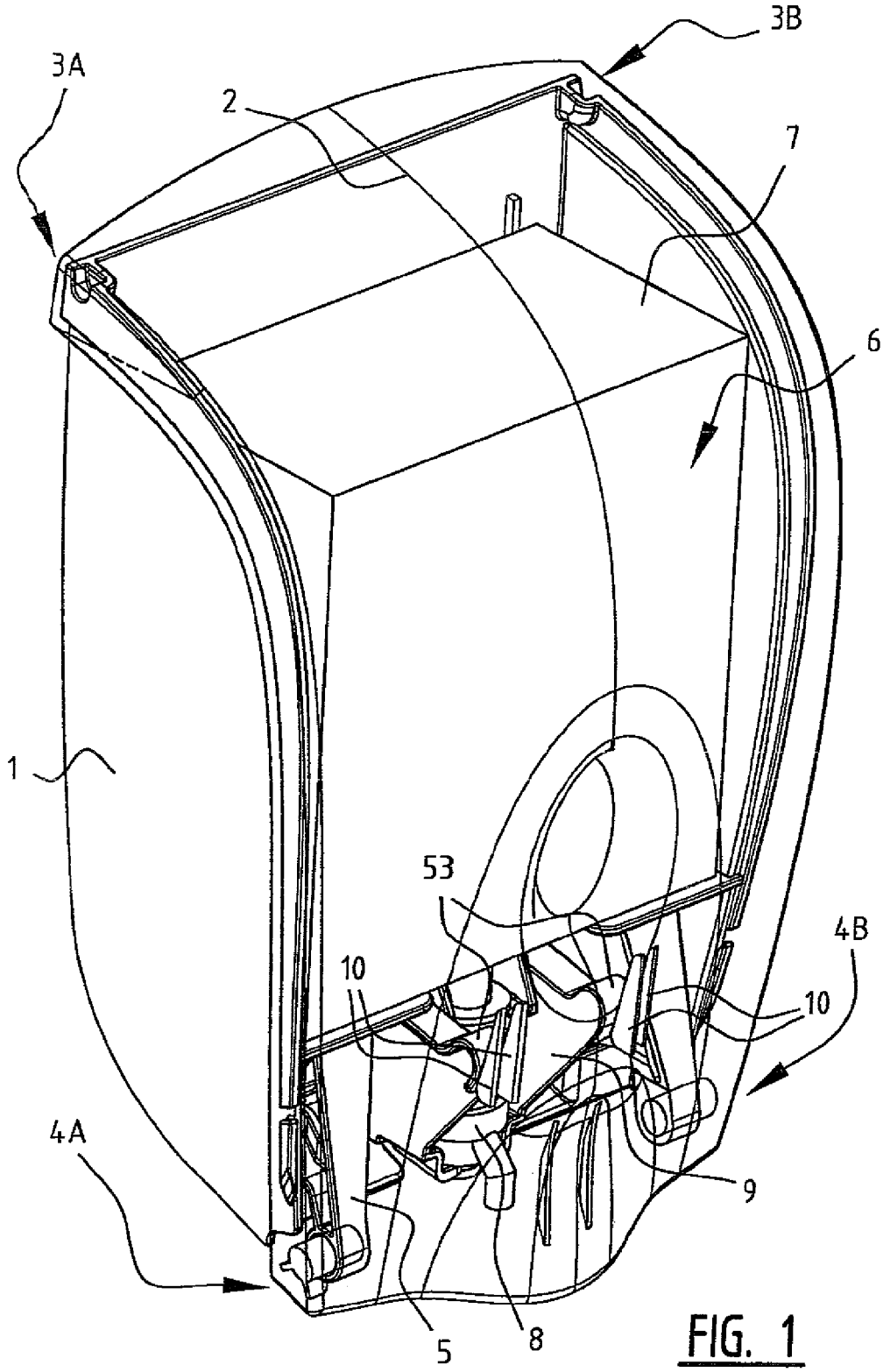
FIG. 1 shows a perspective view of a first embodiment of a dispensing apparatus according the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising," or "having" and variations thereof herein is meant to encompass the items listed thereafter and equivalents thereof as well as additional items. The terms "mounted," "connected," and "coupled" are used broadly and encompass both direct and indirect mounting, connecting and coupling. Finally, as described in subsequent paragraphs, the specific mechanical configurations illustrated in the drawings are intended to exemplify embodiments of the invention. Accordingly, other alternative mechanical configurations are possible, and fall within the spirit and scope of the present invention.

FIG. 1 gives a perspective view of a first embodiment of the dispensing apparatus according to the invention. The dispensing apparatus comprises a base part 1, a cover 2 connected to the base part 1 by means of two hinge points 3*a*,3*b* resp. 4*a*,4*b* and a mounting element 5 for mounting a cartridge 6 of product between the cover 2 and the base part 1. The cartridge 6 of this first embodiment comprises a container 7 filled with product and a bellows pump 8 connected thereto. Furthermore, an actuating element 9 is arranged on the mounting element 5 and in contact with the cover 2 for actuating the bellows pump 8 of the cartridge 6.

Figure 2:
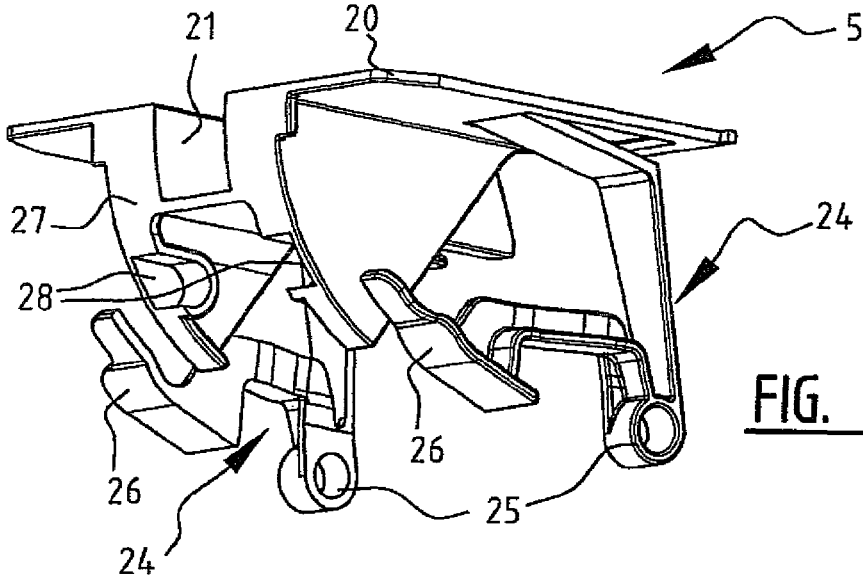
FIG. 2 shows a perspective view of a mounting element.

The mounting element 5 of FIG. 1 is clearly shown in FIG. 2. The mounting element 5 is shown from the back, i.e. the side which is directed to the base part 1 of the dispensing apparatus of FIG. 1. The mounting element 5 is a one-piece structural component, preferably produced from plastic, which accommodates several functions for the dispensing apparatus, as will be explained later on.

The mounting element 5 comprises an upper wall 20 with a recessed part 21 in the centre thereof. This recessed part 21 is more clearly shown in FIG. 5. This recessed part 21 is provided at the front of the mounting element 5 with a substantially U-shaped recess 22. Furthermore, a rib 23 is provided in the recessed upper wall 21.

Two flexible arms 24 extend from the upper wall. Pivot holes 25 and extended portions 26 are integrally connected to these flexible arms 24. Furthermore, the mounting element 5 is provided with two upright walls 27 projecting from the upper wall 20 at right angles. In these upright walls 27, slotted holes 28 are provided.

Figure 3:
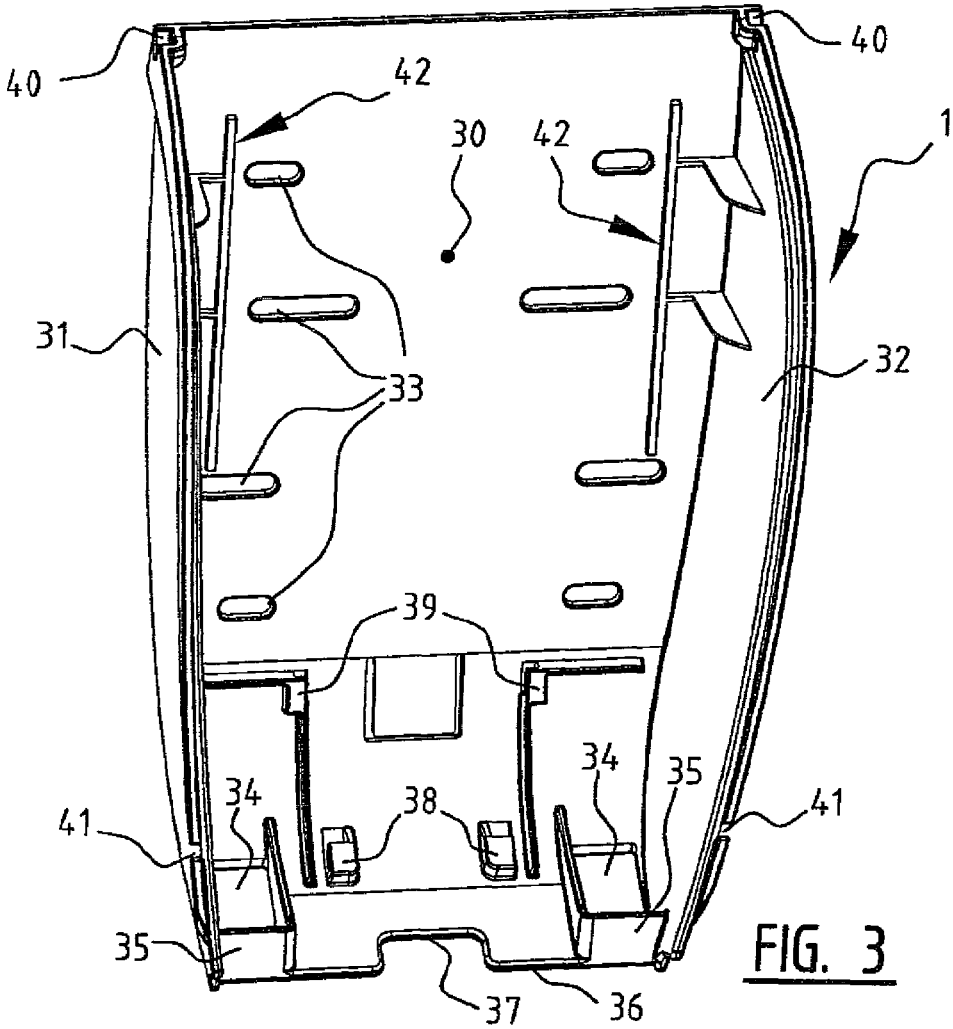
FIG. 3 is a perspective view of a base part.

The base part 1 is clearly shown in FIG. 3. The base part 1 consists mainly of a back plate 30 with a curved lower end and two side walls 31, 32. The back plate 30 is provided with several slotted holes 33 of different dimensions for mounting the base part 1 to a wall of a sanitary room or space where the dispensing apparatus is to be used. Two openings 34 are arranged in the curved lower end of the back plate 30. These openings 34 are limited by retention ribs 35. The front edge 36 of the back plate 30 comprises a recessed part 37. Furthermore, connecting elements 38, 39 are integrally connected to the back plate 30 for cooperating with corresponding portions of the mounting element 5 to connect this element to the base part 1. The side walls 31,32 of the base part 1 have front edges in which slotted holes 40 at the upper end of the dispensing apparatus and interruptions 41 near the lower end of the dispensing apparatus are provided. Finally, the base part 1 has on its inner side positioning elements 42 for positioning a cartridge in its proper location.

Figure 5:
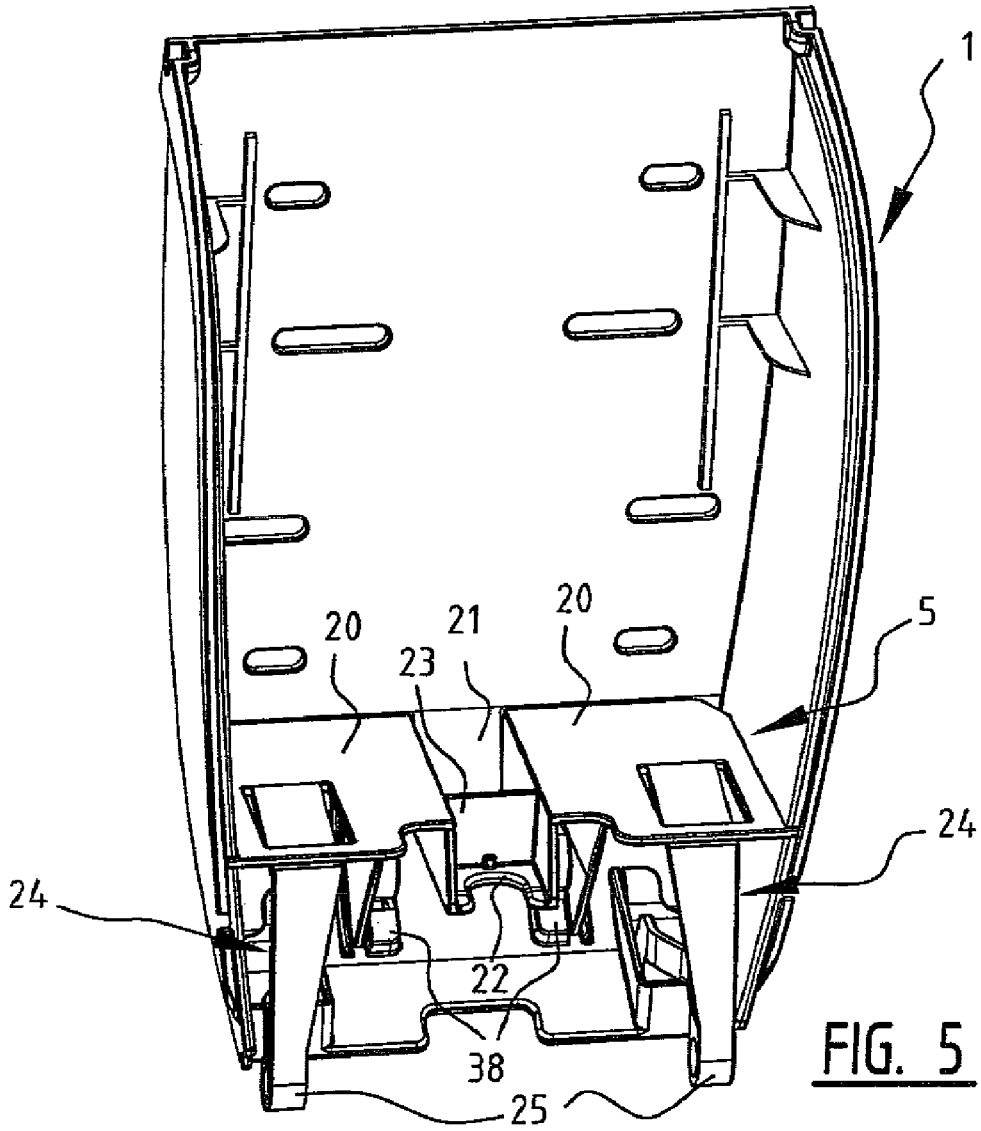
FIG. 5 is a perspective view of the mounting element of FIG. 2 arranged in the base part of FIG. 3.

FIG. 5 shows how the mounting element 5 of FIG. 2 is mounted to the base part 1 of FIG. 3. The extended portions 26 of the mounting element 5 are positioned in the openings 34 of the lower curved end of the base part 1 (see also FIG. 11). The connecting elements 38,39 on the back plate 30 connect the mounting element 5 to the base part 1. The flexible arms 24 project forward with the pivot holes 25 at the lower end of the back part 1.

Figure 4:
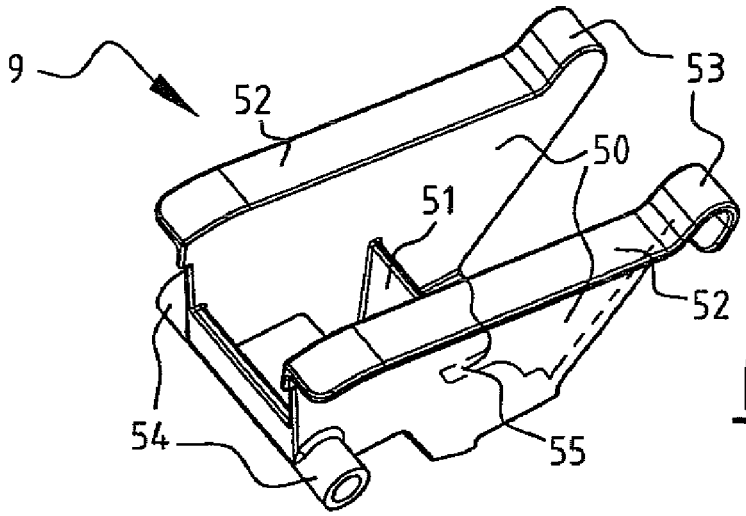
FIG. 4 is a perspective view of an actuating element.

The actuating element 9 is more clearly shown in FIG. 4. This element comprises two parallel walls 50 mutually connected by a rib 51. Each wall 50 is connected to a flange 52, which has a curved end 53 at the front of the actuating element 9 (right side in FIG. 4). These curved ends 53 cooperate with ribs 10 on the inner side of cover 2 (see FIG. 1). Furthermore, pivoting pins 54 are provided at the back side of the actuating element 9, whereas a slotted opening 55 is provided at the front thereof. The pivoting pins 54 cooperate with the slotted holes 28 of the mounting element 5 (see FIG. 2). In this way, the actuating element 9 is pivotally connected to the mounting element 5.

Figure 7:
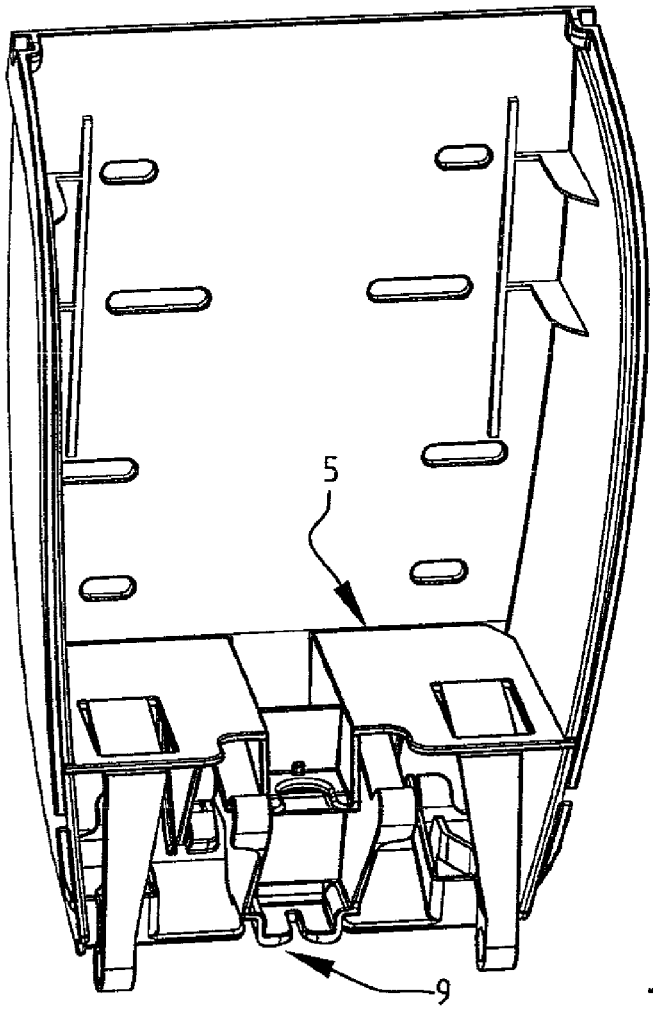
FIG. 7 shows the actuating element of FIG. 4 arranged in the assembly of FIG. 5.

FIG. 7 shows how the actuating element 9 of FIG. 4 is mounted to the assembly of FIG. 5. The actuating element 9 can rotate freely about a hinge point consisting of the pivoting pins 54 of the actuating element 9 and the slotted holes 28 of the mounting element 5. This hinge point is not shown in FIG. 7, because it lies at the back side (i.e. between the element 5,9 and the back plate 30).

Figure 6:
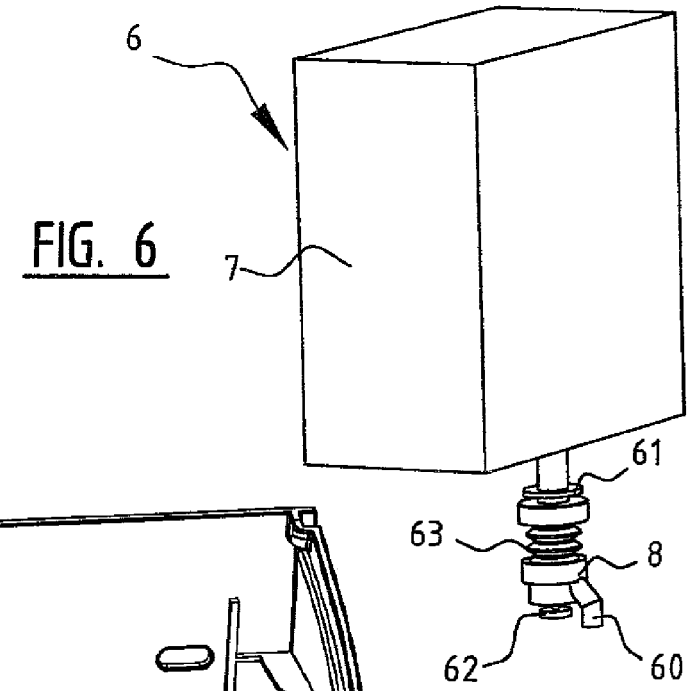
FIG. 6 shows a cartridge comprising a container and a bellows pump.

FIG. 6 shows one example of a cartridge 6 for loading in the dispensing apparatus according to the invention. This cartridge 6 comprises a container 7 filled with product and a bellows pump 8. When the bellows pump 8 is pushed toward the container 7, a quantity of product will be dispensed. The bellows pump 8 is provided with a nozzle 60 through which the product will leave the cartridge 6. Furthermore, the bellows pump 8 is provided with retention rings 61,62. Between these retention rings 61,62 the bellows part 63 of the pump is located.

Figure 8:
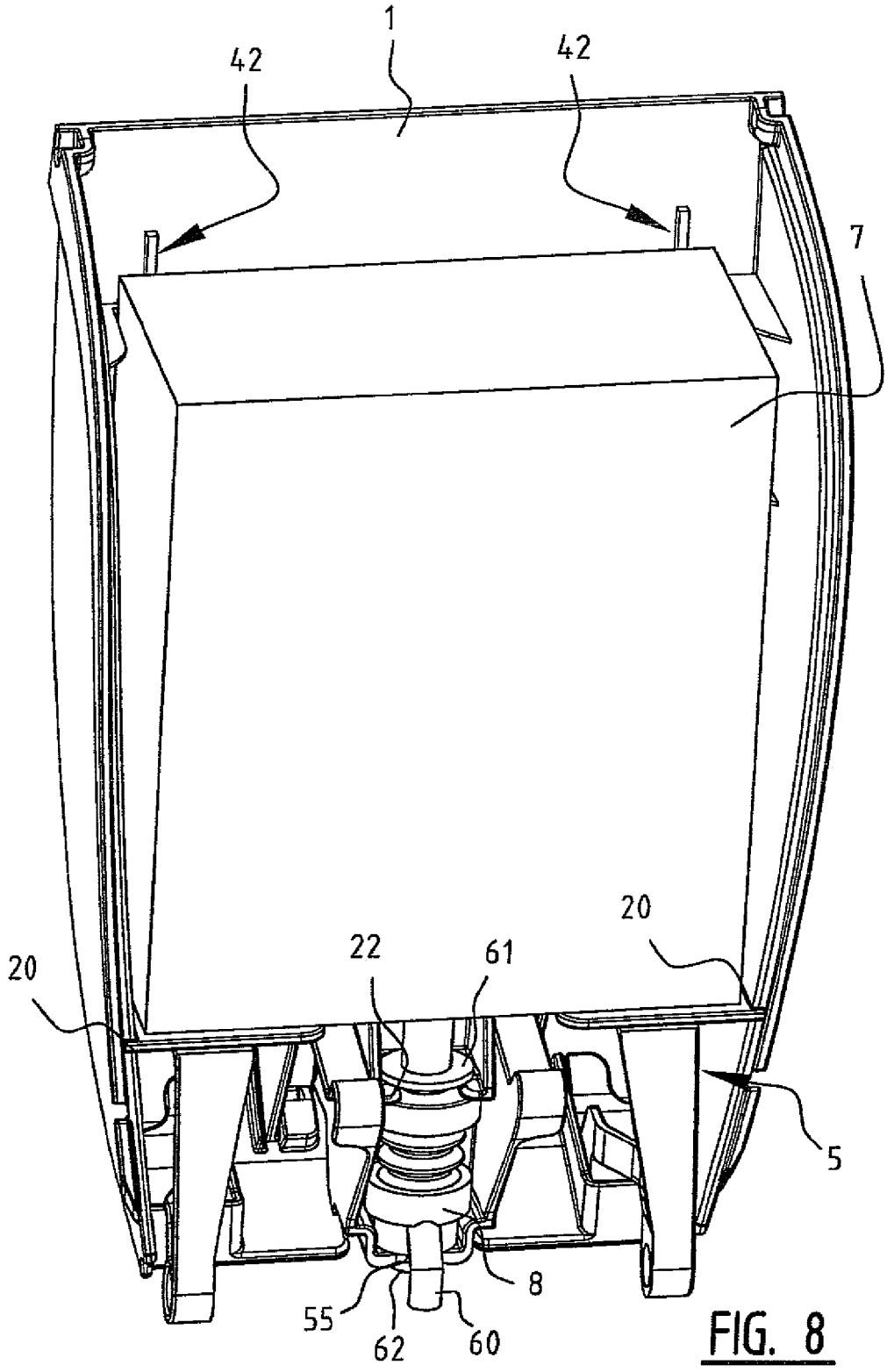
FIG. 8 shows the cartridge of FIG. 6 arranged in the assembly of FIG. 7.

In FIG. 8, the assembly of cartridge 6 and assembly according to FIG. 7 is depicted. The container 7 is supported by the upper wall 20 of the mounting element 5. Thereby, the container 7 rest against the positioning elements 42 on the back plate 30 of the base part 1. The bellows pump 8 is retained by means of its retaining rings 61,62 in the U-shaped recess 22 of the mounting element 5 and the slotted opening 55 of the actuating element 9. The nozzle 60 of the bellows pump 8 extends downwardly.

Figure 9:
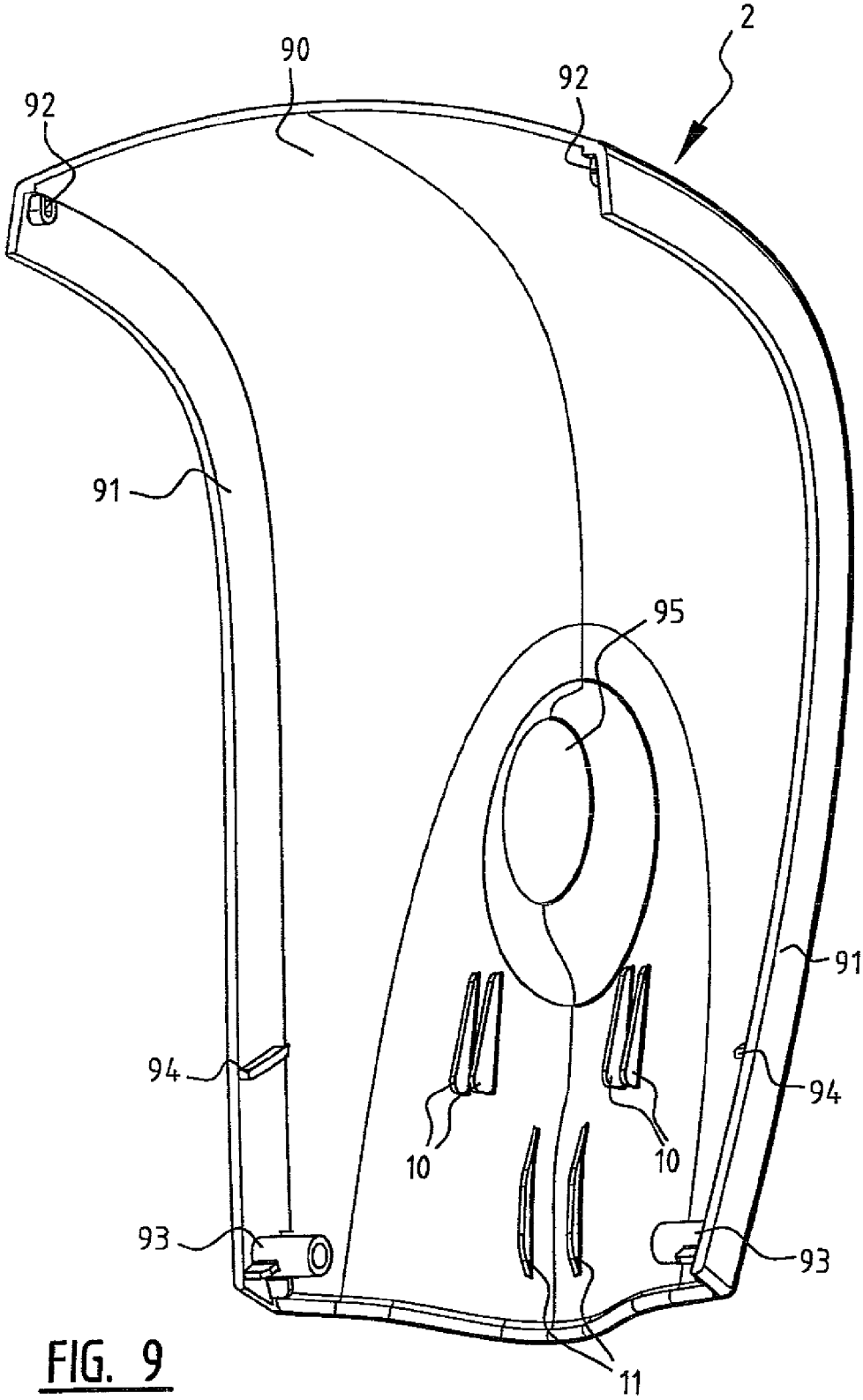
FIG. 9 shows a perspective view of a cover.

The cover 2 is more clearly shown in FIG. 9. The cover has a front wall 90 and two side flanges 91. At the upper end of the cover 2 there are provided two pivoting pins 92. Two further pivoting pins 93 are provided at the lower end of the cover 2. The side flanges 91 are provided with ribs 94 near the lower end of the cover 2. The pivoting pins 92,93 and ribs 94 are all integrally connected to the side flanges 92 of the cover 2. A recessed portion 95 of the front wall 90 is meant to be touched by a user when product has to be dispensed. Ribs 10 at the inner side of front wall 90 cooperate with the curved ends 53 of the actuating element 9 for actuating the bellows pump. Ribs 1 have a similar function when a cartridge comprising a foam pump is loaded in the dispensing apparatus (see FIG. 10). The flexible arms 24 provide for returning the cover 2 to its rest position when it is released.

FIG. 1 shows the complete assembly, including the cover 2 of FIG. 9. The pivoting pins 92 of the cover 2 and the slotted holes 40 of the base part 1 cooperate to form the first hinge point 3*a*,3*b* of the cover 2. The pivoting pins 93 of the cover 2 and the pivot holes 25 of the mounting element 5 cooperate to form the second hinge point 4*a*,4*b* of the cover 2. The second hinge point 4*a*,4*b* is not operative in the position shown in FIG. 1. It is only operative when the first hinge point 3*a*,3*b* is released, i.e. the pivoting pins 92 are lifted from the slotted holes 40. Releasing of the first hinge point 3*a*,3*b* is locked due to the connection between the extended portions 26 of the mounting element 5 and the openings 34 of the base part 1.

Figure 10:
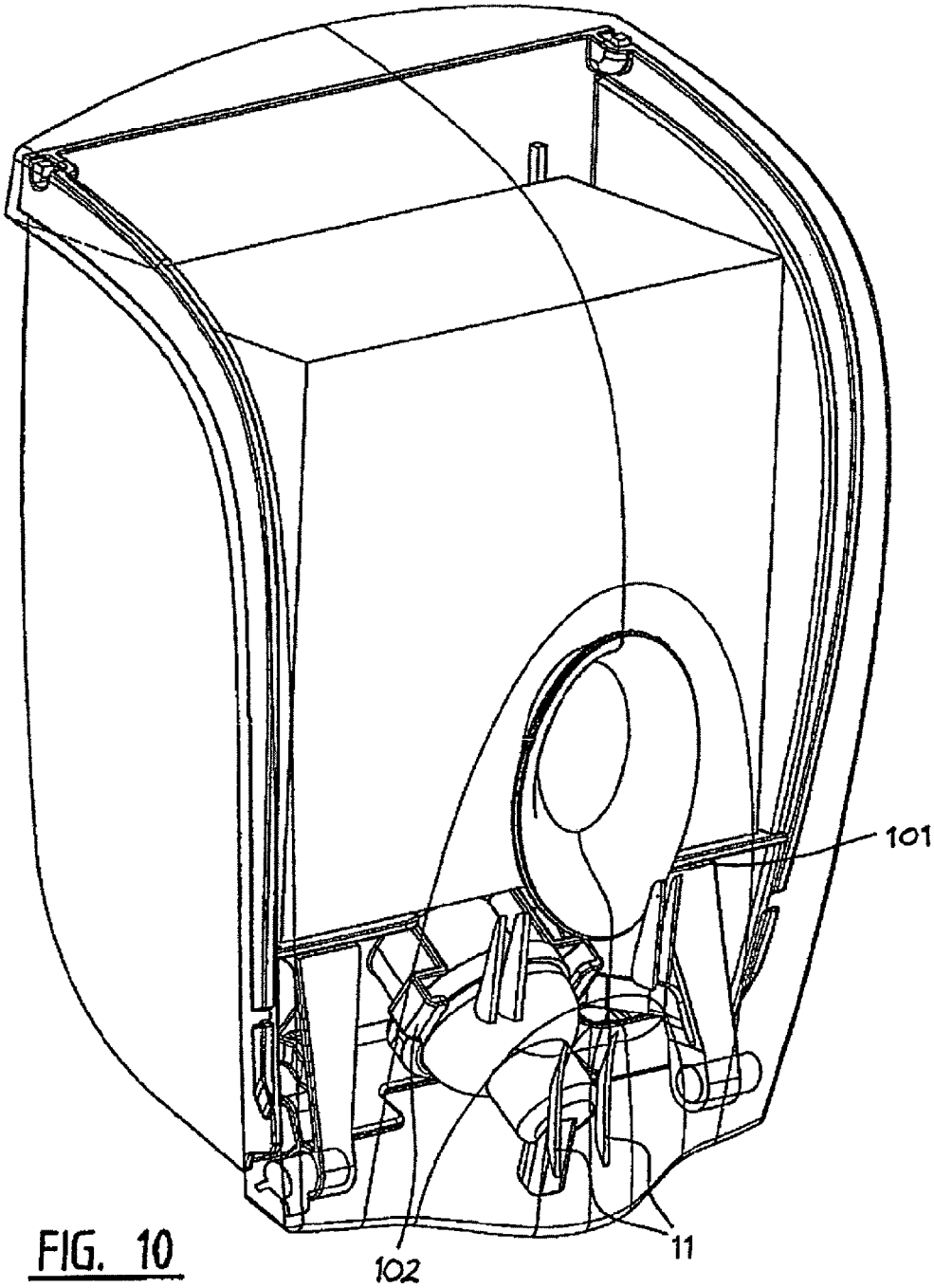
FIG. 10 shows a perspective view of a second embodiment of a dispensing apparatus according to the invention.

FIG. 10 shows a second embodiment of the dispensing apparatus according to the invention. This embodiment is suited for a cartridge comprising a container 7 filled with product and a foam pump 100. The base part 1, the cover 2 and the mounting element 101 are substantially identical to those of the first embodiment. The mounting element 101, however, comprises fixing lips 102 extending from the upper wall 20 in a forward downward direction for fixing the foam pump 100. Another difference is that the actuating element 9 of the first embodiment is not needed in this second embodiment. Pivoting movement of the cover about first hinge point 3*a*,3*b* directly results in an actuating movement of the foam pump and thus a dispensing of product.

Figure 11:
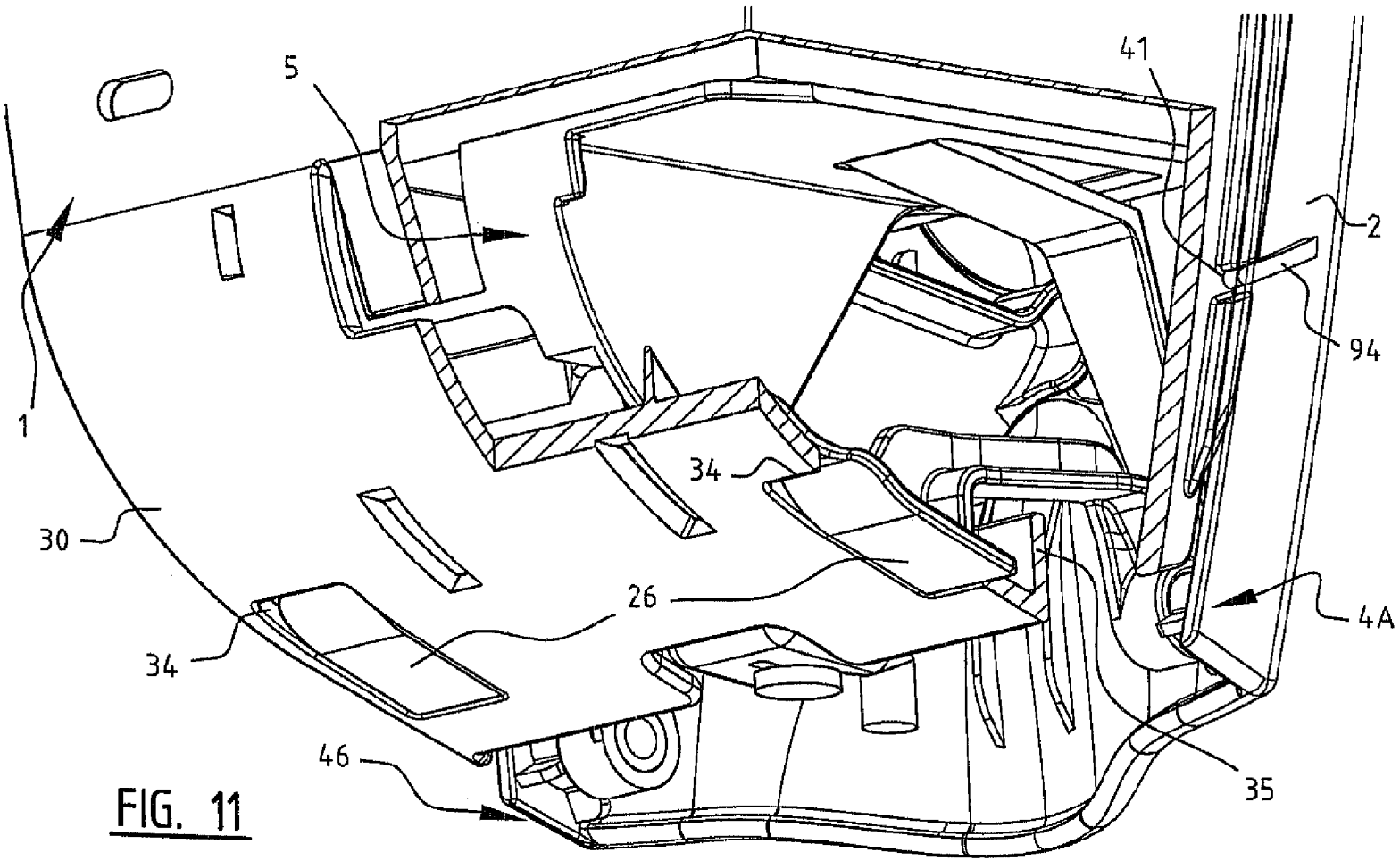
FIG. 11 shows a partly cut away view of the bottom side of the dispensing apparatus of FIG. 1.

FIG. 11 shows a detail of the lower end of the dispensing apparatus of the first embodiment. The mounting element 5 is locked in the base part 1 by means of the extended portions 26 cooperating with the openings 34. From this situation it is not possible to lift the cover with respect to the base part because this relative movement is prevented by the ribs 94 cooperating with the interruptions 41. For bringing the cover 2 in a cartridge-loading position, the extended portions 26 have to be pushed inward. The extended portions 26 will release from the back plate 30 and the mounting element 5 can be pulled forward (right side in FIG. 11). This movement in forward direction is limited by ribs 35 on the curved lower end of the back plate 30 in order to prevent a complete removal of the cover 2 from the base part 1. As soon as the cover 2 is pulled forward, the ribs 94 will release from the interruptions 41. At that moment it is possible to lift the cover and release the first hinge point 3*a*,3*b* so that the cover 2 can be rotated about the second hinge point 4*a*,4*b* to the cartridge-loading position.

According to this embodiment of the invention a dispensing apparatus is provided having a maximum of four structural elements: a base part, a cover, a mounting element and an actuating element (only in case of a bellow pump type of cartridge). The mounting element combines the functions of mounting the cartridge in the dispensing apparatus, returning the cover after dispensing of product, providing a hinge point for opening the cover in order to unload and load a cartridge and locking the movement of the cover to its cartridge-loading position.

Figure 12:
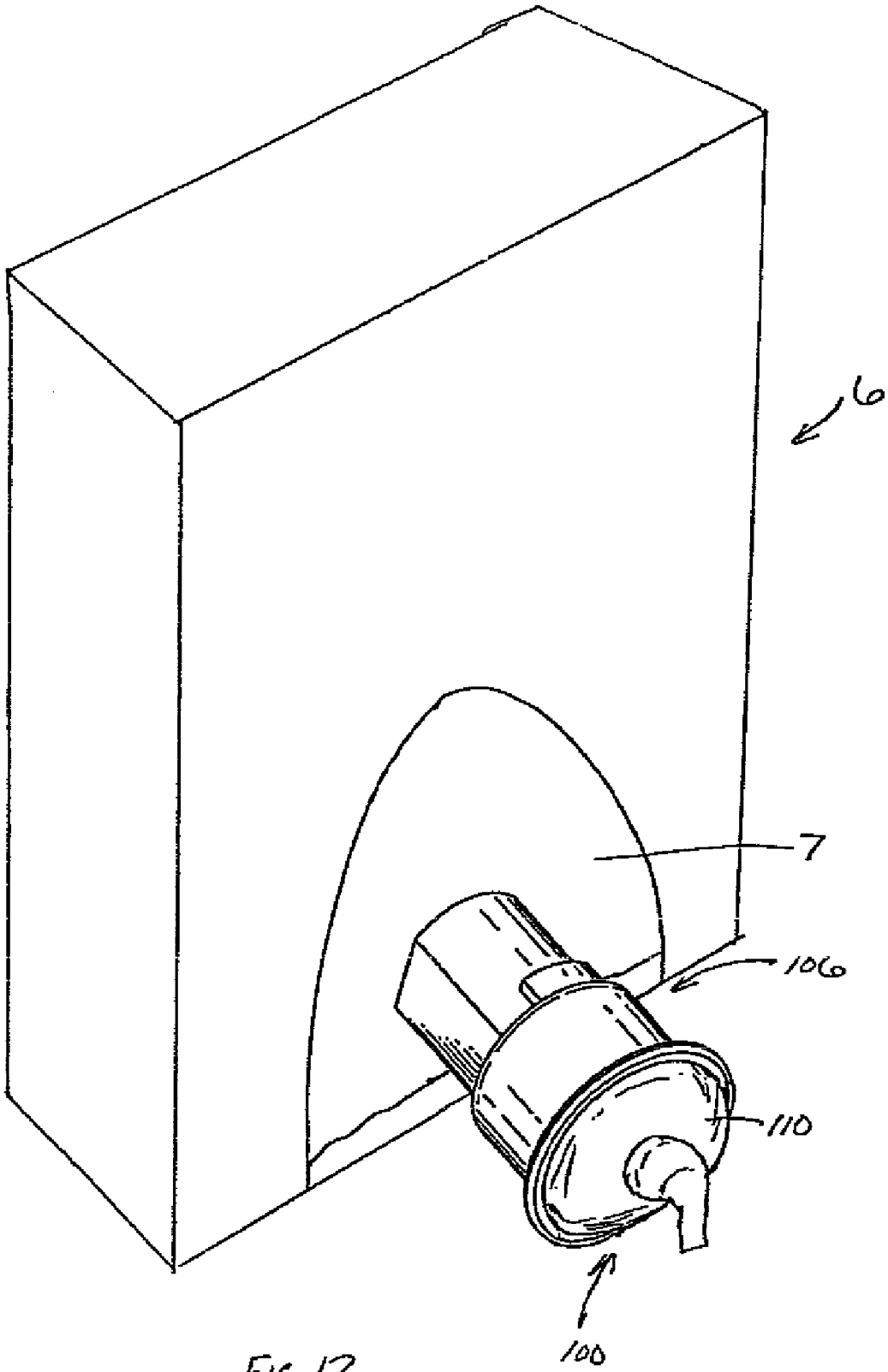
FIG. 12 shows a cartridge comprising a container with a new housing and a foam pump coupled to the housing.

FIG. 10 shows a second embodiment of the dispensing apparatus according to the invention. This embodiment is suited for a cartridge comprising a container 7 filled with product and a foam pump 100. Such a cartridge is illustrated in FIG. 12. The foam pump illustrated is manufactured by Bentfield Europe BV of the Netherlands. The base part 1, the cover 2 and the mounting element 101 of this dispenser are substantially identical to those of the first embodiment. The mounting element 101, however, comprises fixing lips 102 extending from the upper wall 20 in a forward downward direction for fixing the foam pump 100. This manner of fixation and orientation will be discussed in greater detail below. Furthermore, due to the manner in which the foam pump 100 is mounted in the mounting element 101, the actuating element 9 of the first embodiment is not needed in this second embodiment. Specifically, the foam pump 100 is mounted such that pivoting movement of the cover about first hinge point 3*a*,3*b* directly results in an actuating movement of the foam pump and thus a dispensing of product.

Figure 13:
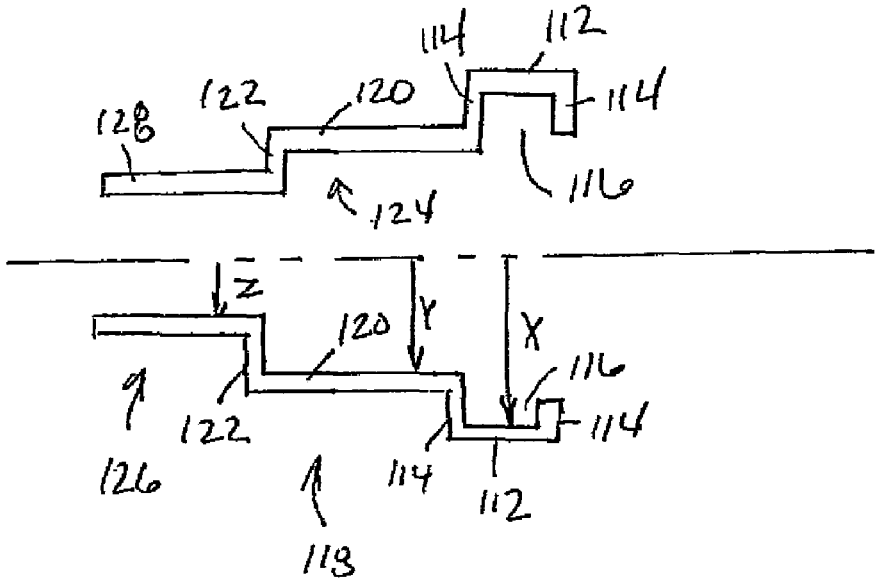
FIG. 13 is an exemplary illustration of a mounting device for receiving the housing on the soap container.

As shown in greater detail in FIGS. 10 and 13, the fixing lips 102 have a stepped profile to receive a specific portion of the cartridge and or the pump 100. Specifically, the fixing lips 102 of this embodiment receive a portion of a housing 106 attached to the cartridge and portions of the pump 100 coupled to the housing 106. The stepped profile of the fixing lips 102 along with other features discussed herein allow for easier alignment and orientation of the cartridge within the dispenser.

The stepped profile of the fixing lips 102 can be described in some embodiments to include three portions with each portion specifically sized to receive a particular part of the housing 106 and/or pump 100. In the illustrated embodiment, the sections sequentially step from a larger to small steps. However, in other embodiments, the size or profile of each section can vary in different manners. Focusing on the illustrated embodiment shown in FIGS. 10 and 13, the three portions are co-axial and each portion is substantially symmetric about the axis. The first portion 108 is sized to receive a cap 110 on the foam pump 100, as well as a flange 160 on the housing 106. Specifically, this portion has two substantially parallel walls 112 positioned a first distance X from the axis. On either axial end of the walls 112, another wall 114 extends a short distance in the radial direction to define a recess or channel 116 to receive the pump cap 110 or more particularly, a rib 111 extending around the cap 110. Although this first portion 108 is described as having two walls 112, it should be understood that one annular wall can replace the two discreet walls.

The second portion 118 of the fixing lips 102 is positioned adjacent the first portion 108. The second portion 118 is sized to receive a portion of the housing 106. Specifically, this second portion 118 has two substantially parallel walls 120 positioned a second distance Y from the axis. As illustrated, the second distance Y of this embodiment is less than the first distance X. On one axial end of the walls 120, another wall 122 extends a short distance in the radial direction to define a recess 124 to receive a portion of the housing 106. Although this second portion 118 is described as having two walls 120, it should be understood that one annular wall can replace the two discreet walls.

The third portion 126 of the fixing lips 102 is positioned adjacent the second portion 118. The third portion 126 is sized to receive another portion of the housing 106 described below. Specifically, this portion 126 of the fixing lips 102 has two substantially parallel walls 128 positioned a third distance Z from the axis. As illustrated, the third distance Z of this embodiment is less than the second distance Y. Although this third portion 126 is described as having two walls 128, it should be understood that in other embodiments one annular wall may be able to replace the two discreet walls.

Figure 14:
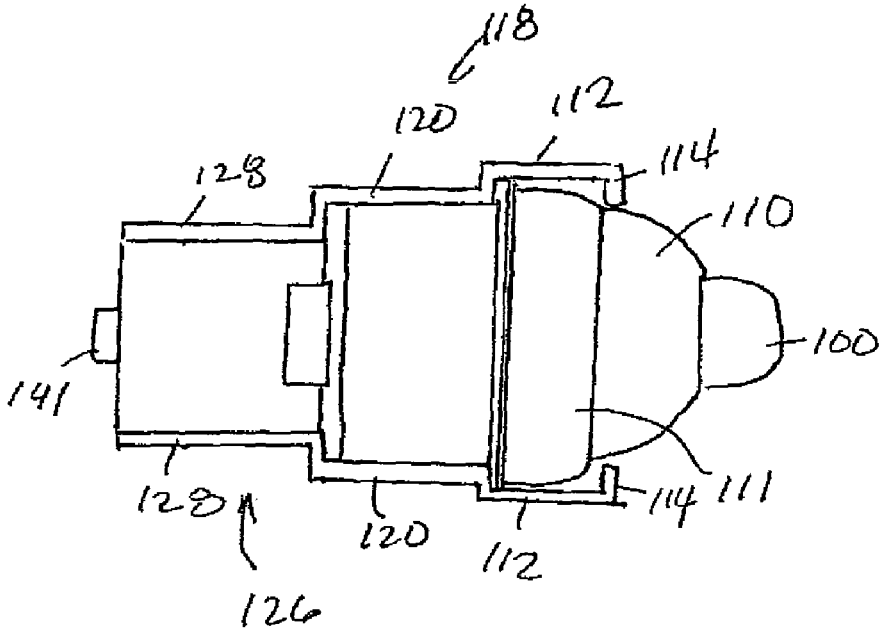
FIG. 14 is another exemplary illustration of the mounting device shown in FIG. 13 with a housing and pump positioned in the mounting device.
Figure 15:
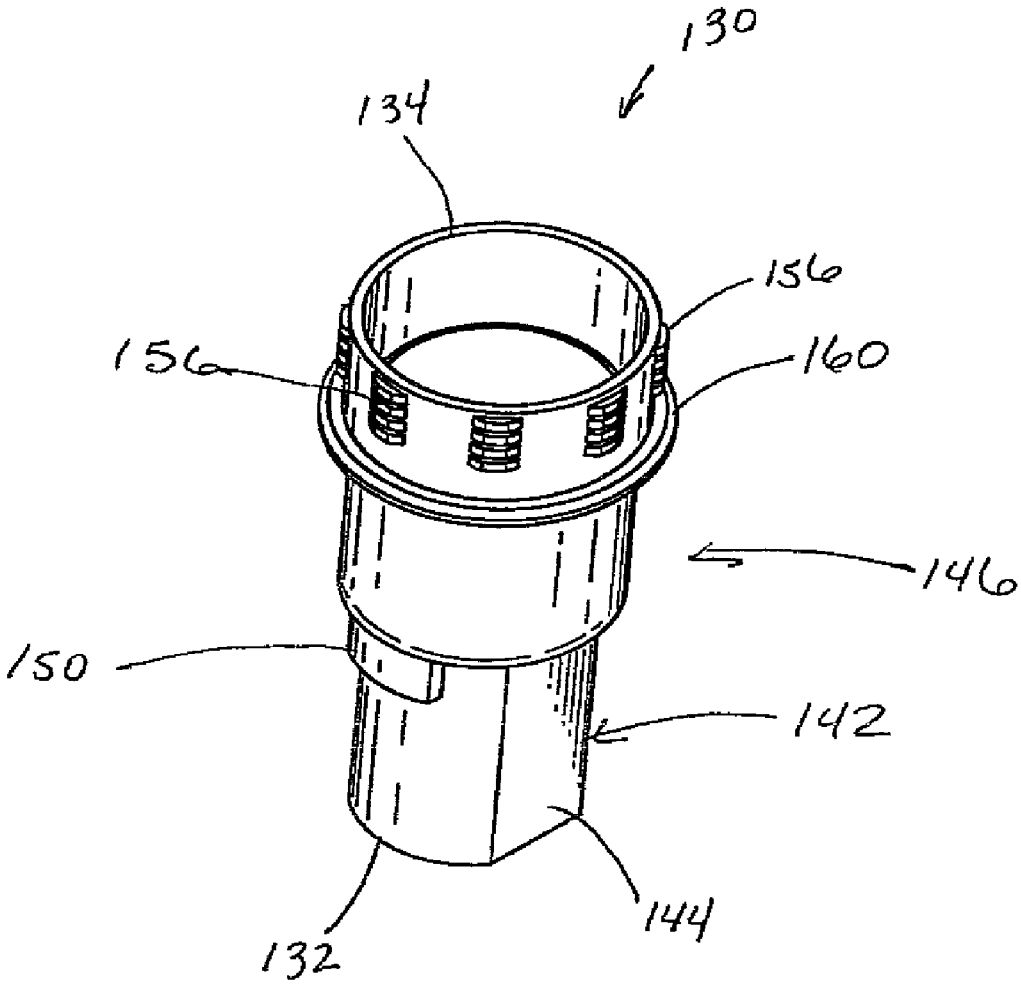
FIG. 15 is a perspective view of a new housing that is adapted to connect a soap container to a pump.
Figure 16:
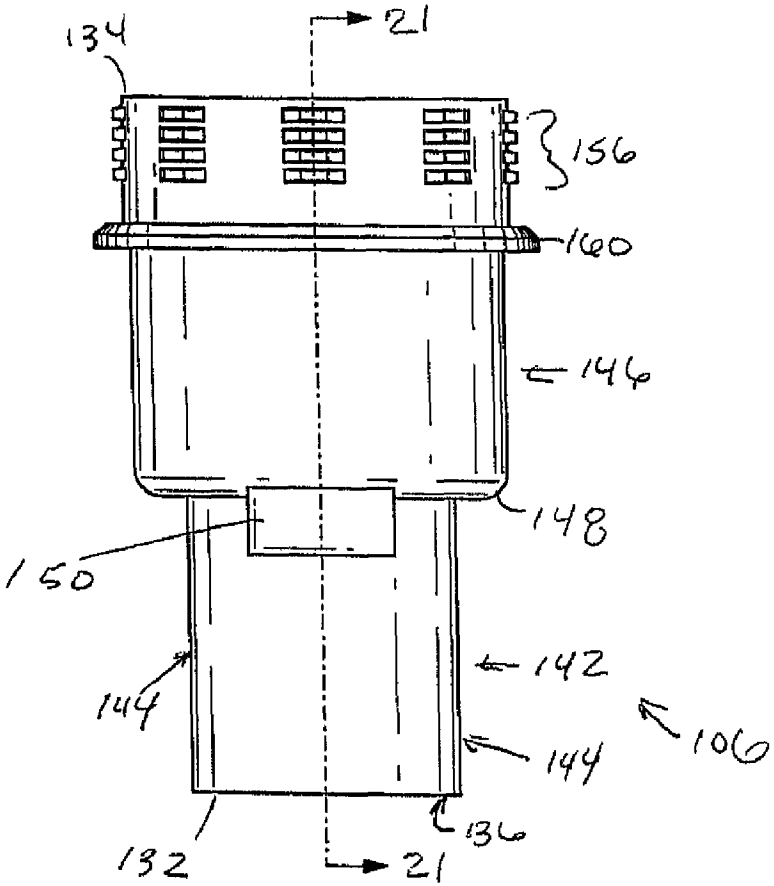
FIG. 16 is a front view of the housing illustrated in FIG. 15.
Figure 17:
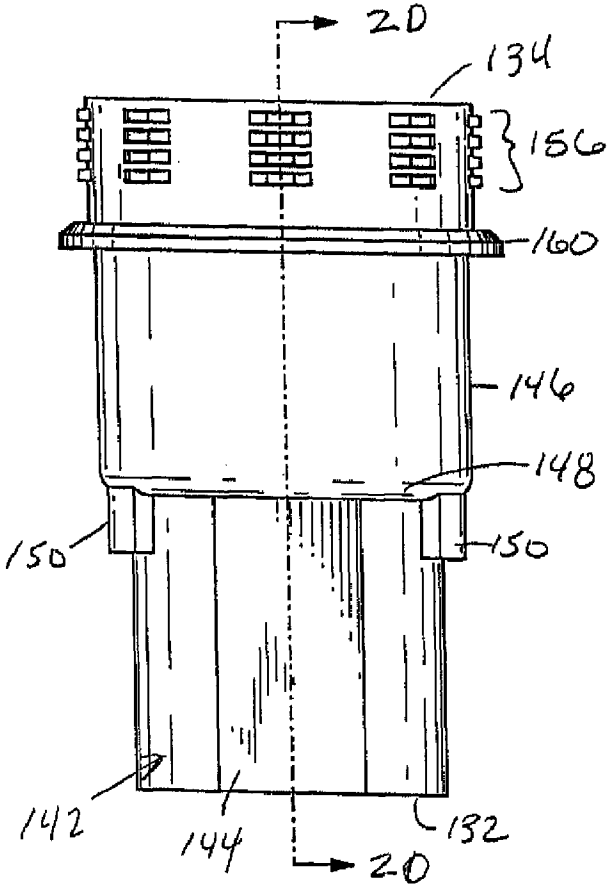
FIG. 17 is a side view of the housing illustrated in FIG. 15.
Figure 19:
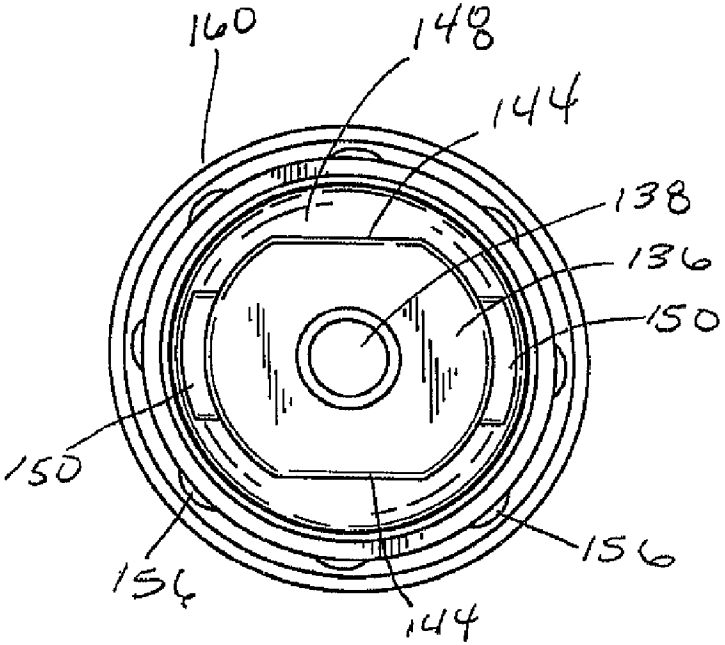
FIG. 19 is a top view of the housing illustrated in FIG. 15.
Figure 18:
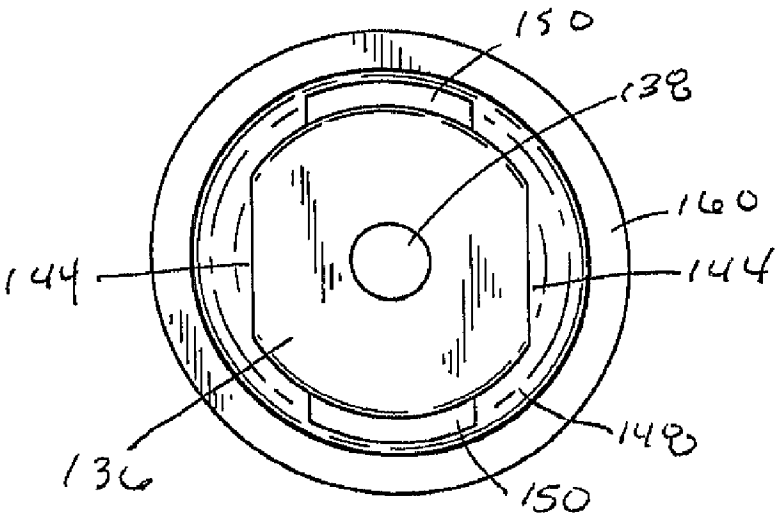
FIG. 18 is a bottom view of the housing illustrated in FIG. 15.
Figure 20:
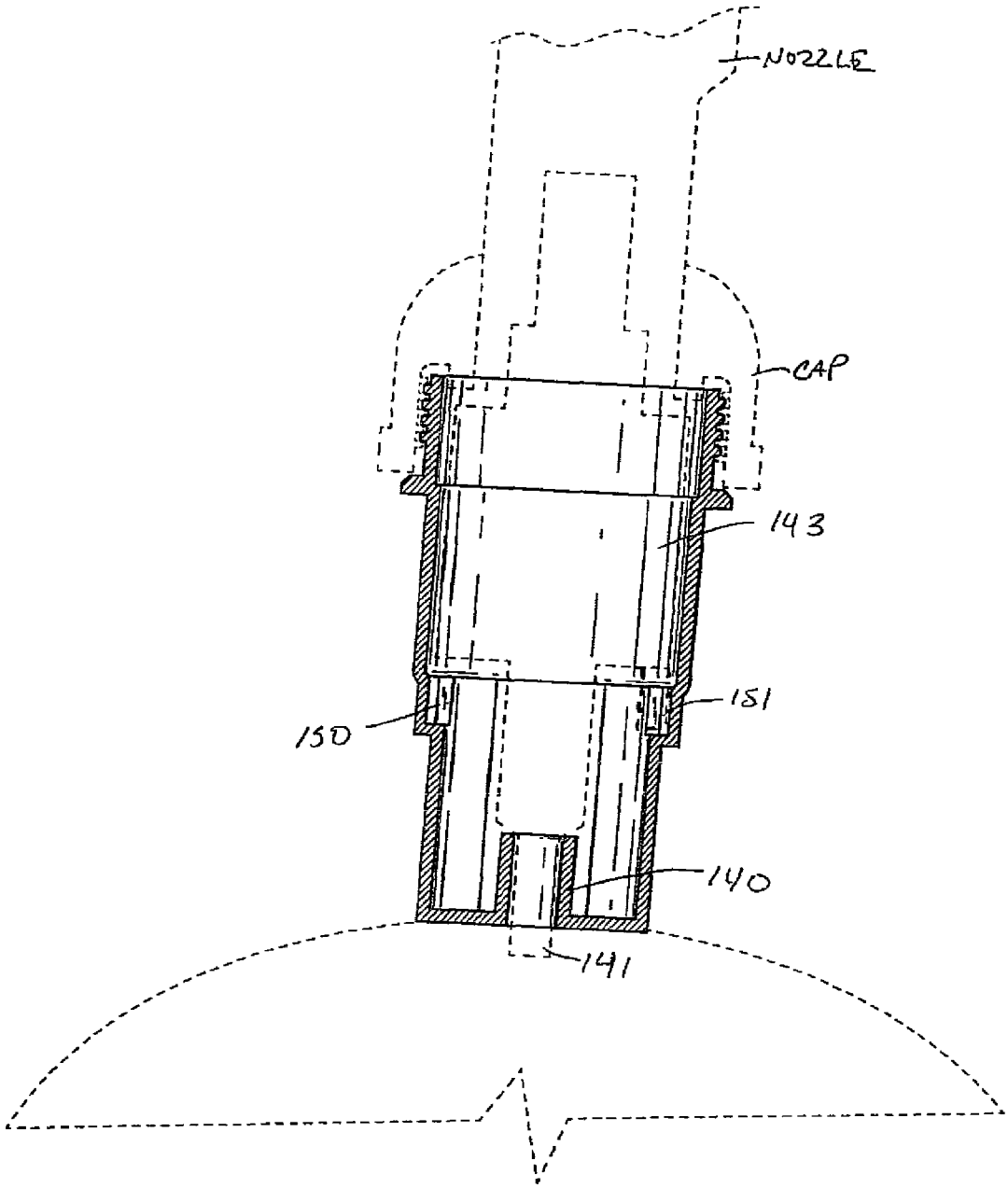
FIG. 20 is a cross-section of the housing illustrated in FIG. 15 with the cross-section taken along line 20-20 of FIG. 17. The housing is also shown coupled to a soap container and a soap pump is shown coupled to the housing.
Figure 21:
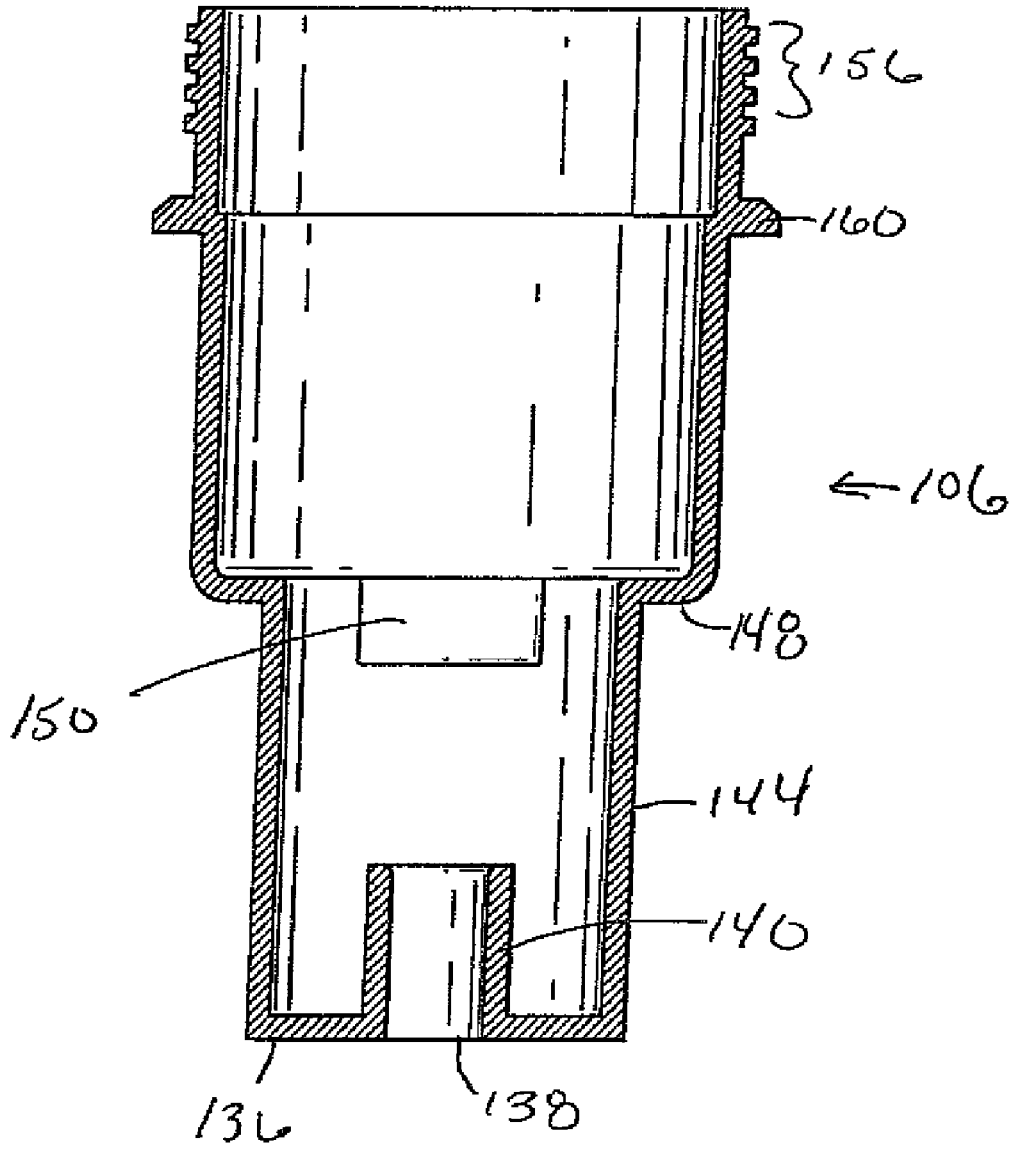
FIG. 21 is a cross-section of the housing illustrated in FIG. 15 with the cross-section taken along line 21-21 of FIG. 16.

The housing 106 and cap 110 are shown received in the fixing lips 102 of the mounting element 101 in FIG. 14. This figure will be described in greater detail below once the housing of FIGS. 15-21 is described.

The housing 106 shown in FIGS. 15-21 has a generally cylindrical body 130 having first end 132 and a second end 134. An opening is formed in each end 132, 134 of the body. A base 136 is coupled to first end 132 of the generally cylindrical body 130. The base 136 is used to couple the housing 106 to the soap container within the cartridge. The base 136 can be coupled to the container many different ways. For example, it can be adhesively or cohesively bonded, it can be welded, and the like. The illustrated housing 106 is particularly adapted to be ultra sonically welded to the container. The base 136 has an aperture 138 to allow communication between the contents of the soap container and the housing 106. As illustrated, the aperture 138 of this embodiment is centered on the base 136. A tube or conduit 140 is coupled to the base 136 and is aligned with the aperture 138 of the base. The conduit 140 is cylindrically shaped and extends from the base 136 into the housing 106. The conduit 140 is sized and configured to receive a dip tube 141 from the pump 100.

The housing 106, like the mounting element 101, is configured to allow the cartridge to be easily inserted and oriented within the dispenser. Accordingly, the housing 106 is provided with one or more alignment and configuration features. Specifically, the housing 106 has two chambers that are configured differently for alignment and configuration purposes. A first chamber 142 is coupled to the base 136 and extends from the base 136. This first chamber 142 has an outer periphery with an orientation member that can only be received within the dispenser as select number of ways. Specifically, in the illustrated embodiment, this member includes at least one substantially flat surface 144. More specifically, the orientation member of the illustrated embodiment includes two substantially flat surfaces 144 extending along the first chamber 142 in the axial direction. Two cylindrical or arcuate surfaces connect the two flat sections long the periphery of the first chamber. The flat surfaces reduce the cross-sectional area of the first chamber 142. It is this reduced cross-sectional area that is designed to mate with a portion of the mounting element 101 and more specifically, with the third portion 126 of the fixing lips 102. Due to the need of this reduced cross-sectional area to properly align with the mounting element 101, the housing 106 can only be oriented two different ways relative to the dispenser, wherein each different way is 180 degrees apart. Accordingly, the proper orientation of the housing 106 should be fairly obvious once the housing 106 is coupled to the soap container. These flat portions 144 also help prevent unwanted rotation of the housing within the fixing lips 102.

A second chamber 146 is coupled to the first chamber 142 at a shoulder 148. The second chamber 146 is substantially co-axial with the first chamber 142. The first and second chamber are dimensioned and configured to receive select portions of the pump 100. For example, in the illustrated embodiment, the dip tube assembly 141 is received within the first chamber of the housing 106 while the pump actuation assembly 143 is received substantially within the second chamber 146. Due in part to the configuration of the pump 100, the first chamber 142 has a smaller cross-sectional width than the second chamber 146. Furthermore, the first chamber 142 has a smaller volume than the second chamber 146.

The shoulder 148 between the first and second chamber can be used to provide assurance that the pump 100 is positioned at the correct depth within the housing 106, which can also assure that the dip tube 141 extends within the soap container a sufficient distance.

At least one cavity 150 is positioned within the housing 106 to receive an alignment member on the pump 100. For example, in the illustrated embodiment, a cavity 150 extends from the shoulder 148 in the axial direction along the first chamber. The cavity 150 is positioned and shaped to receive a projecting alignment member 151 on the soap pump. Receipt of the projecting alignment member 151 within the cavity 150 allows for proper alignment of the soap pump 100 on the soap container so that the nozzle will be aimed in the correct direction once the soap container is installed in the soap dispenser. In the illustrated embodiment, the housing 106 is provided with two cavities 150 that are positioned opposite each other. As such, the cross-section of the housing 106 is symmetrical. Accordingly, the housing 106 can be coupled to the soap container two ways and yet allow for proper alignment.

The housing 106 also has a plurality of ribs 156 extending from the outer periphery of the second chamber 146. The plurality of ribs 156 are located at the second end 134, or free end, of the second chamber 146. The plurality of ribs 156 are positioned and dimensioned to engage an internal threaded surface of the soap pump. More specifically, the ribs 156 are dimensioned and configured to engage the threaded surface via a snap fit. This allows for the housing 106 to connect to the pump 100 more quickly compared to prior art devices. In the illustrated embodiment, the ribs 156 are generally aligned in parallel rows. Furthermore, the ribs 156 do not extend around the entire periphery of the housing within a row. In other words, the ribs 156 only cover a portion of the circumferential area within a one row.

Finally, as illustrated, the housing 106 also has a larger rib or flange 160 positioned adjacent the plurality of ribs 156. This larger rib or flange 160 can be used as a stop to prevent further movement of the pump 100 or cap 110 on the pump 100 in the axial direction while the pump 100 is being coupled to the housing 106. Furthermore, as shown in the figures and as discussed above, the flange 160 can be received within the first portion 108 of the fixing lips 102 to further provide proper alignment of the pump 100 with the dispenser and to prevent axial movement of the pump 100 and housing 106 during operation.

In operation, the housing 106 is attached to the soap container prior to reaching the end user The housing 106 is attached to the container in the proper orientation such that the flats 144 and the cavities 150 are properly positioned to provide the correct orientation of the pump 100. The pump 100 can optionally be coupled to the housing 106 before or after reaching the end user. The pump 100 is inserted into the housing 106 with the dip tube 141 end first. The dip tube 141 aligns with the product feed tube 140 and can be inserted through the product feed tube 140. Also, the pump 100 is properly oriented so that the alignment projection 151 aligns with the proper cavity 150 to have the nozzle facing the correct direction With this proper alignment, the pump cap 110 can be force fit or snap fit onto the plurality of ribs 156 to join the pump 100 to the housing 106.

As shown in FIGS. 10 and 14, the soap container is placed in the dispenser with the housing 106 positioned toward the front of the dispenser. The housing 106 and pump assembly l00 are aligned with the fixing lips 102 of the mounting element 101. Specifically, the stepped profile of the housing 106 is matched with the stepped profile of the fixing lips 102. Once the housing 106 is aligned with the fixing lips 102, the housing 106 (and pump 100) can be inserted into the fixing lips 102. The flats 144 of the housing 106 should be properly aligned with the third portion 126 of the fixing lips 102 to assure proper alignment. Once the soap container, housing 106, and pump 100 are inserted, the cover on the soap dispenser can be closed to allow for dispensing.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention. For example, various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

Various features of the invention are set forth in the following claims.

What is claimed is:

1. A housing adapted to couple a soap pump to a soap container for use within a dispenser, the housing comprising:

a base adapted to couple the housing to the soap container, the base having an aperture allowing communication between contents of the container and the housing;

a first chamber coupled to the base and extending from the base, the first chamber having an outer periphery defined by at least one substantially flat surface, the substantially flat surface configured to be received within the dispenser at a specific rotational orientation; and a second chamber coupled to the first chamber at a shoulder, the second chamber being substantially co-axial with the first chamber, and a first cavity extending from the shoulder along and in a direction away from the first chamber, the first cavity positioned to receive a portion of the soap pump to align the soap pump with respect to the housing.

2. The housing as claimed in claim 1, further comprising a second cavity extending from the shoulder along and away from the first chamber, the second cavity being positioned opposite the first cavity, the second cavity positioned and shaped to receive a portion of the soap pump to align the soap pump on the soap container.

3. The housing claimed in claim 1, wherein the at least one substantially flat surface of the first chamber is a first substantially flat surface, the outer periphery of the first chamber further comprising a second substantially flat surface positioned opposite the first substantially flat surface.

4. The housing claimed in claim 3, wherein the outer periphery of the first chamber further comprises a first and second arcuate surface extending between the first substantially flat surface and the second substantially flat surface, the first arcuate surface positioned opposite the second arcuate surface.

5. The housing claimed in claim 1, wherein the volume of the second chamber is greater than the volume of the first chamber.

6. The housing claimed in claim 5, wherein the first and second chambers are positioned co-axially about an axis, the walls of the second chamber extending a greater distance from the axis than the walls of the first chamber.

7. The housing claimed in claim 1, further comprising a feed tube extending from the base of the housing into the first chamber, the feed tube being co-axial with the first chamber and dimensioned to receive a dip tube on the soap pump.

8. The housing claimed in claim 1, further comprising a plurality of ribs extending from the outer periphery of the second chamber at a location adjacent a free end of the second chamber, the plurality of ribs positioned and dimensioned to engage an internal threaded surface of the soap pump.

9. The housing claimed in claim 8, wherein the ribs are further dimensioned to engage the threaded surface via a snap fit.

10. A soap dispenser comprising:

a dispenser housing with a mounting device for receiving and orienting a pump and a housing, the mounting device having a stepped profile including a first portion having at least a portion of an annular recess, the annular recess positioned about an axis;

a second portion positioned adjacent the first portion, the second portion having at least a portion of an annular recess positioned about the axis, the radius of the second annular recess being less than the radius of the first annular recess; and a third portion positioned adjacent the second portion, the third portion being coaxial with the second portion and having a first and second wall positioned substantially the same distance from the axis on opposite sides of the axis;

a soap container received within the dispenser housing;

a housing coupled to the soap container and at least partially received within the mounting device, the housing comprising a first chamber coupled to the soap container and dimensioned to be received within the third portion of the mounting device at a specific rotational orientation;

a second chamber coupled to the first chamber and being substantially co-axial with the first chamber, the second chamber dimensioned to be received within the second portion of the mounting device, and a cavity extending from the second chamber and at least partially into the first chamber; and a pump at least partially received within the housing and the first portion of the mounting device, the pump including a projecting member extending from a portion of the pump in the second chamber and at least partially into the first chamber, the projecting member disposed in the cavity for orienting the pump within the housing.

11. The soap dispenser of claim 10, wherein the first and second walls of the third portion of the mounting device are positioned from the axis a distance less than the radius of the second portion.

12. The soap dispenser of claim 10, wherein the first chamber of the cartridge housing has an outer periphery defined by at least one substantially flat surface.

13. The soap dispenser of claim 12, wherein the at least one substantially flat surface of the first chamber is a first substantially flat surface, the outer periphery of the first chamber further comprising a second substantially flat surface positioned opposite the first substantially flat surface, the first and second substantially flat surfaces being separated by a distance substantially equal to the distance between the first and second wall of the third portion of the mounting device.

14. The soap dispenser of claim 10, further comprising a plurality of ribs extending from the outer periphery of the second chamber at a location adjacent a free end of the second chamber, the plurality of ribs positioned and dimensioned to engage an internal threaded surface of the soap pump.

15. The soap dispenser of claim 10, where the second chamber further comprises a flange extending from the outer periphery of the second chamber adjacent a free end of the housing, the flange at least partially received within the first portion of the mounting device.

16. A soap container pumping assembly for installation into a mounting device having first and second co-axial chambers, the soap container pumping assembly comprising:

a housing coupled to the soap container, the housing comprising a generally cylindrical body having a first end and a second end, the second end coupled to the soap container;

a plurality of ribs coupled to the first end, the plurality of ribs at least partially defined by rows of parallel ribs, the plurality of ribs only covering a portion of the circumferential area within at least one row;

a first housing chamber coupled to the soap container and dimensioned to be received within the first chamber of the mounting device at a specific rotational orientation; and a second housing chamber coupled to the first housing chamber and being substantially co-axial with the first housing chamber, the second housing chamber dimensioned to be received within the second chamber of the mounting device; and a cavity extending from the second housing chamber at least partially along and away from the first housing chamber; and a pump assembly at least partially received within and coupled to the housing, the pump assembly comprising a generally cylindrical body having a first end and a second end, the first end being dimensioned to be received within the housing;

a projecting member extending from a portion of the pump assembly in the second housing chamber and at least partially into the first housing chamber, the projecting member dimensioned for mating engagement in the cavity for orienting the pump within the housing; and a cap coupled to the generally cylindrical body adjacent to the second end of the body, the cap having an internally threaded surface positioned and dimensioned to engage the plurality of ribs in a snap fit arrangement.

17. The soap container pumping assembly of claim 16, wherein the pump comprises a projecting member that extends from a portion of the pump and is received within a cavity in the housing.

18. A soap container pumping assembly for use with a soap dispenser, the assembly comprising:

a housing coupled to the soap container, the housing comprising a generally cylindrical body having a first end and a second end, the second end coupled to the soap container and having a substantially flat surface configured to be received within the dispenser at a specific rotational orientation; and a cavity located inside the generally cylindrical body; and a pump assembly at least partially received within and coupled to the housing, the pump assembly comprising a generally cylindrical body having a first end and a second end, the first end being dimensioned to be received within the housing; and a projection extending from a portion of the generally cylindrical body of the pump, the projection dimensioned to be received within the cavity of the housing and located to properly position portions of the pump for dispensing.

19. The soap container pumping assembly of claim 18, further comprising:

a plurality of ribs coupled to the first end of the generally cylindrical body of the housing, the plurality of ribs at least partially defined by rows of parallel ribs, the plurality of ribs only covering a portion of the circumferential area within at least one row; and a cap coupled adjacent to the second end of the generally cylindrical body of the pump, the cap having an internally threaded surface positioned and dimensioned to engage the plurality of ribs in a snap fit arrangement.

20. A dispensing apparatus for dispensing a product from a container, the dispensing apparatus comprising:

a base part;

a cover connected to the base part by means of two hinge points, a first releasable hinge point being provided for pivoting the cover with respect to the base part for dispensing product, a second hinge point being provided for moving the cover into a container-loading position, wherein the second hinge point is operative if the first hinge point is released, and a mounting element for mounting the container of product between the cover and the base part, wherein the second hinge point is arranged between the cover and the mounting element, which is locked in the base part, the mounting element including a flexible arm biased to return the cover to a non-dispensing position.

21. The dispensing apparatus according to claim 20, wherein the mounting element comprises at least an extended portion cooperating with an opening in the base part.

22. The dispensing apparatus according to claim 21, wherein the base part comprises at least a retention rib cooperating with the extended portion of the mounting element for preventing the cover from separating from the base part.

23. The dispensing apparatus according to claim 20, wherein the first hinge point is arranged between the cover and the base part and releasable by relative movement between those two.

24. The dispensing apparatus according to claim 20, further comprising cooperating blocking means between the cover and the base part for blocking relative movement between those two.

25. The dispensing apparatus according claim 20, further comprising resilient means for returning the cover around the first hinge point to the non-dispensing position after releasing the cover, wherein the resilient means are integrally connected to the mounting element.

26. The dispensing apparatus according to claim 25, wherein the resilient means comprises at least the flexible arm of the mounting element.

27. A dispensing apparatus for dispensing a product from a container, the dispensing apparatus comprising:

a base part;

a cover connected to the base part by means of two hinge points, a first releasable hinge point being provided for pivoting the cover with respect to the base part for dispensing product, a second hinge point being provided for moving the cover into a container-loading position, wherein the second hinge point is operative if the first hinge point is released;

a mounting element for mounting the container of product between the cover and the base part, characterized in that the second hinge point is arranged between the cover and the mounting element, which is locked in the base part, the mounting element including a flexible arm; and resilient means for returning the cover around the first hinge point to a non-dispensing position after releasing the cover, the resilient means integrally connected to the mounting element and including at least the flexible arm of the mounting element, a first part of the second hinge point is integrally connected to the flexible arm of the mounting element and a second part of the second hinge point is connected to the cover.

28. The dispensing apparatus according claim 27, wherein the first part comprises a pivot hole in the flexible arm and the second part comprises a pivoting pin integrally connected to the cover.

29. The dispensing apparatus according to claim 20, further comprising an actuating element pivotally connected to the mounting element for actuating a bellows pump connected to the product container.

30. The dispensing apparatus according to claim 20, wherein the apparatus is assembled to a product container.

31. The dispensing apparatus according to claim 30, wherein the container has a bellows pump connected thereto.

32. The dispensing apparatus according to claim 30, wherein the container has a foam pump connected thereto.

33. The dispensing apparatus according to claim 31, wherein the container is replaceable.

34. The dispensing apparatus according to claim 33, wherein the container together with the pump is replaceable.

* * * * *